United States Patent [19]

Kawamura

[11] Patent Number: 5,070,826

[45] Date of Patent: Dec. 10, 1991

[54] ELECTROMAGNETIC VALVE ACTUATING SYSTEM

[75] Inventor: Hideo Kawamura, Koza, Japan

[73] Assignee: Isuzu Ceramics Research Institute Co., Ltd., Fujisawa, Japan

[21] Appl. No.: 571,528

[22] PCT Filed: Dec. 28, 1989

[86] PCT No.: PCT/JP89/01336

§ 371 Date: Nov. 13, 1990

§ 102(e) Date: Nov. 13, 1990

[87] PCT Pub. No.: WO90/07639

PCT Pub. Date: Jul. 12, 1990

[30] Foreign Application Priority Data

Dec. 28, 1988 [JP] Japan ..... 63-334961

[51] Int. Cl.[5] ..... F01L 9/04

[52] U.S. Cl. ..... 123/90.11; 251/129.01

[58] Field of Search ..... 123/90.11, 90.15; 251/129.01, 129.05, 129.09

[56] References Cited

U.S. PATENT DOCUMENTS

| | | | |
|---|---|---|---|
| 4,515,343 | 5/1985 | Pischinger | 123/90.11 |
| 4,544,986 | 10/1985 | Buchl | 123/90.11 |
| 4,715,332 | 12/1987 | Kreuter | 123/90.11 |
| 4,759,528 | 7/1988 | Morris . | |
| 4,777,915 | 10/1988 | Bonvallet | 123/90.11 |
| 4,829,947 | 5/1989 | Lequesne | 123/90.11 |
| 4,841,923 | 6/1989 | Buchl | 123/90.11 |

FOREIGN PATENT DOCUMENTS

| | | | |
|---|---|---|---|
| 0162312 | 9/1984 | Japan | 123/90.11 |
| 0183805 | 9/1984 | Japan | 123/90.11 |

*Primary Examiner*—E. Rollins Cross
*Assistant Examiner*—Weilun Lo
*Attorney, Agent, or Firm*—Staas & Halsey

[57] ABSTRACT

An electromagnetic valve actuating system opens and closes intake and exhaust valves of an engine under electromagnetic forces generated by an electromagnet. A reciprocally movable magnetic pole (6) in the form of an amorphous magnetic body is wound as multiple layers on an intake/exhaust valve (9). An upper fixed magnetic pole (3*a*) confronts one end of the movable magnetic pole (4), and a distal fixed magnetic pole (3*c*) confronts the other end of the movable magnetic pole. When the intake/exhaust valve (9) is to be driven in an opening direction, the movable magnetic pole (4) is attracted by the upper fixed magnetic pole (3*a*). When the intake/exhaust valve (9) is to be driven in a closing direction, the movable magnetic pole (4) is attracted by the distal fixed magnetic pole (3*c*). Since the movable magnetic pole (4) is light in weight, forces required to open and close the valve may be small, and the electromagnetic valve actuating system may be small in size.

12 Claims, 3 Drawing Sheets

ELECTROMAGNETIC VALVE ACTUATING SYSTEM

BACKGROUND OF THE INVENTION

1. Field of the Invention

The present invention relates to an electromagnetic valve actuating system for opening and closing intake and exhaust valves of an engine under electromagnetic forces generated by an electromagnet.

2. Description of the Related Art

Some conventional actuating systems for opening and closing intake and exhaust valves include a single camshaft which has cams to operate the intake and exhaust valves, the camshaft being disposed above or laterally by an engine. The camshaft is operatively connected to the crankshaft of the engine by a belt or the like, so that the camshaft can rotate synchronously with the rotation of the engine.

In other valve actuating systems, an intake camshaft having cams for acting on intake valves and an exhaust camshaft having cams for acting on exhaust valves are disposed above an engine. The intake and exhaust valves are opened when the stem ends of the intake valves are directly pushed by the cam surfaces of the intake camshaft and the stem ends of the exhaust valves are directly pushed by the cam surfaces of the exhaust camshaft.

However, the above conventional actuating systems for opening and closing intake and exhaust valves have several disadvantages. First, the conventional systems include camshafts and link mechanisms added to the engine, which necessarily renders the engine large in size.

Secondly, since the camshafts and the link mechanisms are driven by the output shaft of the engine, the engine output power is partly consumed by the frictional resistance produced when the camshafts and the link mechanisms are driven by the engine. As a result, the effective engine output power is reduced.

Finally, the timing with which the intake and exhaust valves are opened and closed cannot be altered during operation of the engine, but the valve opening and closing timing is preset such that the engine operates with high efficiency when it rotates at a predetermined speed. Therefore, the engine output power and efficiency are lower when the engine rotates at a speed different from the predetermined speed.

To solve the above problems, there have been proposed valve actuating systems for opening and closing intake and exhaust valves under electromagnetic forces from electromagnets, rather than with camshafts, as disclosed in Japanese Laid-Open Patent Publications Nos. 58-183805 and 61-76713.

However, with the electromagnets disclosed in the above two publications, the mass of the intake and exhaust valves is increased, and large electric energy must be supplied in order to actuate the intake and exhaust valve under electromagnetic forces produced by the electromagnets.

SUMMARY OF THE INVENTION

In view of the aforesaid problems, it is an object of the present invention to provide an electromagnetic valve actuating system in which a magnetic body disposed on an intake/exhaust valve of an engine is made of an amorphous material, so that a reciprocally drivable portion including the intake/exhaust valve is rendered light in weight, thereby allowing the intake/exhaust valve to be opened and closed under small electromagnetic forces.

According to the present invention, there is provided an electromagnetic valve actuating system which has a reciprocally movable magnetic pole in the form of an amorphous body wound as multiple layers on the intake/exhaust valve. A yoke is provided having an upper fixed magnetic pole confronting one end of the movable magnetic pole, an intermediate fixed magnetic pole coupled to the upper fixed magnetic pole and confronting a side of the movable magnetic pole, and a distal fixed magnetic pole confronting the other end of the movable magnetic pole. A upper coil is provided for generating a magnetic flux passing through the upper fixed magnetic pole, and a lower coil is provided for generating a magnetic flux passing through the distal fixed magnetic pole.

The electromagnetic valve actuating system opens and closes the intake/exhaust valve under attractive forces acting between the reciprocally movable magnetic pole, and the upper and distal fixed magnetic poles.

Since the movable member is light in weight, the electromagnetic valve actuating system may produce a reduced output. Thus, the electromagnetic valve actuating system may be small in size.

DESCRIPTION OF THE PREFERRED EMBODIMENT

An embodiment of the present invention will hereinafter be described in detail with reference to the drawings.

Figure 1:
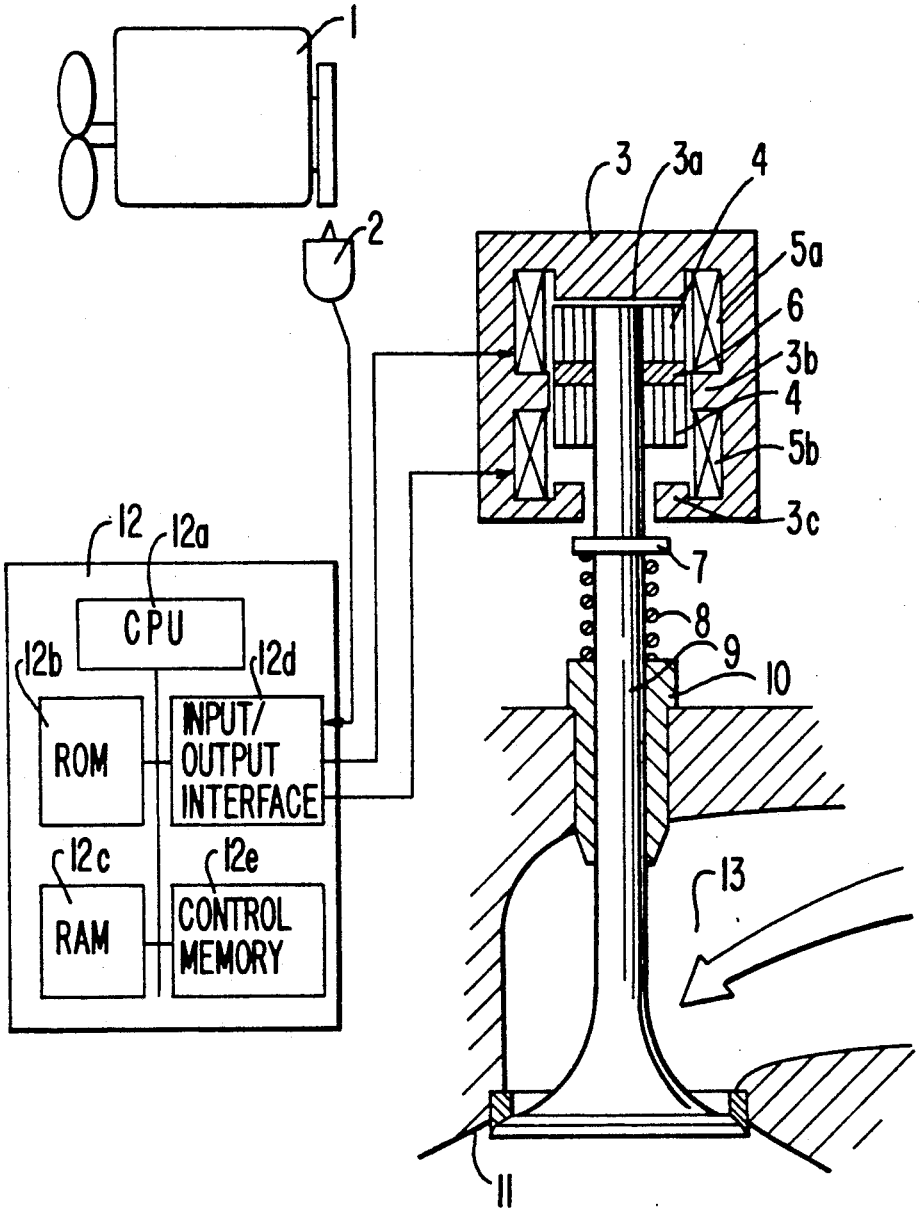
FIG. 1 is a block diagram showing an electromagnetic valve actuating system according to an embodiment of the present invention.

FIG. 1 is a block diagram showing an actuating system according to an embodiment of the present invention.

An engine 1 has an output shaft, adjacent to which there is disposed a rotation sensor 2 for detecting the rotational speed and phase of the output shaft and converting the detected speed and phase into a signal. The engine 1 has intake and exhaust ports which are opened and closed by intake and exhaust valves, respectively. Of these intake and exhaust valves, the intake valve will mainly be described below.

An intake valve 9 comprises a highly strong, lightweight valve which is made of a nonmagnetic material such as ceramic. The intake valve 9 has a stem axially slidably supported by a valve guide 10.

A valve seat 11 is mounted in the intake port of an intake passage 13. The intake port is closed when the head of the intake valve 9 is closely held against the valve seat 11.

An amorphous magnetic body 4 is connected to the stem end of the intake valve 9. The amorphous magnetic body 4 comprises a foil of amorphous material wound around the outer circumferential surface of the intake valve 9. The amorphous magnetic body 4 is divided into upper and lower portions with a magnetically permeable plate 6 being interposed therebetween, the plate 6 being made of a magnetic material.

A flange 7 is mounted on the stem of the intake valve 9. Between the flange 7 and the valve guide 10, there is disposed a spring 8 for preventing the intake valve 9 from dropping into the engine cylinder when the engine is not in operation.

An electromagnet 3 is disposed around the amorphous magnetic body 4. The electromagnet 3 has an upper fixed magnetic pole 3*a* positioned therein and facing the upper end face of the amorphous magnetic body 4, an intermediate fixed magnetic pole 3*b* extending around and facing the outer circumferential surface of the amorphous magnetic body 4. The electromagnet 3 also has a distal fixed magnetic pole 3*c* disposed in an opening thereof and confronting the lower end face of the amorphous magnetic body 4.

An upper coil 5*a* is disposed in the electromagnet 3 between the upper fixed magnetic pole 3*a* and the intermediate fixed magnetic pole 3*b*, and a lower coil 5*b* is disposed in the electromagnet 3 between the intermediate fixed magnetic pole 3*b* and the distal fixed magnetic pole 3*c*.

The intermediate fixed magnetic pole 3*b* and the amorphous magnetic body 4 are held out of contact with each other, with a small gap defined therebetween.

The rotation sensor 2, the upper coil 5*a*, and the lower coil 5*b* are electrically connected to an input/output interface 12*d* which receives on input signal and transmits output signals in a control unit 12. The control unit 12 includes, in addition to the input/output interface 12*d* which transmits output signals and receives an input signal, a ROM 12*b* for storing a program and data, a CPU 12*a* for effecting arithmetic operations under the control of the program stored in the ROM 12*b*, a RAM 12*c* for temporarily storing the input signals and the results of arithmetic operations, and a control memory 12*e* for controlling the flow of signals in the control unit 12.

Operation of the electromagnetic valve actuating system according to the present invention will be described below.

Figure 2:
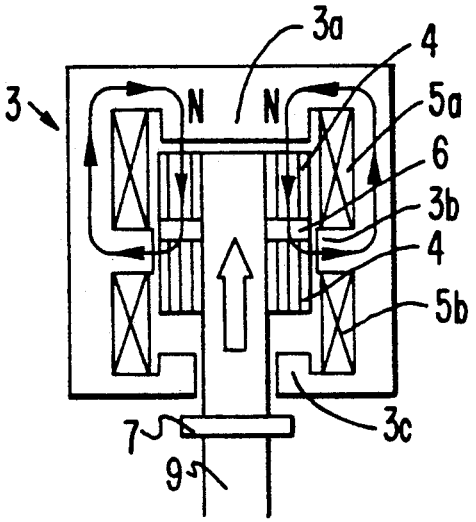
FIGS. 2(*a*) through 2(*c*) are diagrams showing the flow of magnetic lines of force within an electromagnet.
Figure 2:
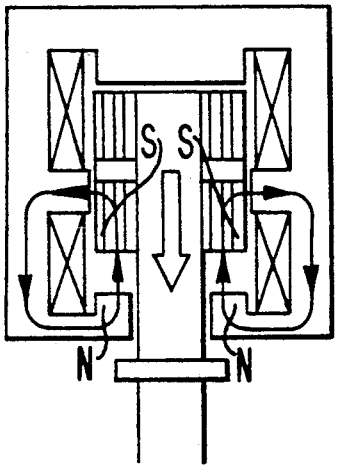
Figure 2:
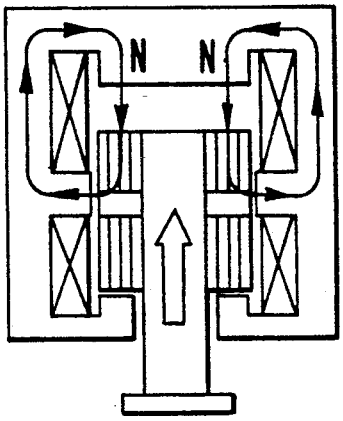

FIGS. 2(*a*) through 2(*c*) show the flow of magnetic lines of force in the electromagnet 3. FIG. 2(*a*) shows the flow of magnetic lines of force when the valve is to be closed. FIG. 2(*b*) shows the flow of magnetic lines of force when the valve starts being opened from the closed condition. FIG. 2(*c*) shows the flow of magnetic lines of force when the valve starts to move in a closing direction after its movement in the opening direction has been decelerated.

In FIG. 2(*a*), the upper coil 5*a* is energized with supplied DC electric energy. Magnetic lines of force generated by the upper coil 5*a* pass through a magnetic path which extends from the upper fixed magnetic pole 3*a* through the amorphous magnetic body 4 and then through the intermediate fixed magnetic pole 3*b* back to the upper fixed magnetic pole 3*a*.

When the magnetic lines of force thus flow from the amorphous magnetic body 4 to the intermediate fixed magnetic pole 3*b*, the magnetic lines of force must move across the laminated layers in the amorphous magnetic body 4. Since the magnetic reluctance across the laminated layers is larger due to interlayer boundaries, it obstructs the flow of the magnetic lines of force.

Therefore, the magnetic lines of force which flow in the laminated layers flow to the magnetically permeable plate 6, and then pass from the magnetically permeable pate 6 to the intermediate fixed magnetic pole 3*b*. In this manner, the magnetic reluctance is reduced, preventing electromagnetic forces from being lowered.

The flow of the magnetic lines of force produce an N (North) pole on the upper fixed magnetic pole 3*a*, and an S (South) pole on the surface of the amorphous magnetic body 4 which faces the upper fixed magnetic pole 3*a*. The upper fixed magnetic pole 3*a* and the amorphous magnetic body 4 are attracted to each other.

Immediately before the upper fixed magnetic pole 3*a* and the amorphous magnetic body 4 contact each other, the head of the intake valve 9 is closely held against the valve seat 11, thereby closing the intake port.

As shown in FIG. 2(*b*), when the rotational phase of the engine 1 as detected by the rotation sensor 2 reaches the timing to open the intake valve 9, the upper coil 5*a* is de-energized, and the lower coil 5*b* is energized.

Magnetic lines of force generated by the lower coil 5*b* flow through a magnetic path which extends from the distal fixed magnetic pole 3*c* to the amorphous magnetic body 4 and then from the amorphous magnetic body 4 through the magnetically permeable plate 6 and the intermediate fixed magnetic pole 3*b* and then back to the distal fixed magnetic pole 3*c*.

In the magnetic path described above, an S pole is produced on the surface of the amorphous magnetic body 4 which faces the distal fixed magnetic pole 3*c* and an N pole is produced on the distal fixed magnetic pole 3*c*, so that the amorphous magnetic body 4 and the distal fixed magnetic pole 3*c* are attracted to each other. Therefore, the intake valve 9 is subjected to a downward attractive force, starting to move in the opening direction.

Upon elapse of a first preset time after the intake valve 9 has started moving in the opening direction, the lower coil 5*b* is de-energized and the upper coil 5*a* is energized again. As with the condition shown in FIG. 2(*a*), the intake valve 9 is subjected to an attractive force in the upward direction, i.e., in the closing direction. The attractive force serves to decelerate the intake valve 9 which is moving in the opening direction, and finally stop the intake valve 9.

FIG. 2(*c*) shows the condition of the intake valve 9 in the position in which it is stopped with the valve completely open. This position corresponds to a position in which it has traversed the maximum downward stroke.

After the intake valve 9 is stopped, the upper coil 5*a* is continuously energized to start moving the intake valve 9 in the upward direction, i.e., in the closing direction.

After elapse of the first preset period of time and upon elapse of a second preset time, the upper coil 5*a* is de-energized and the lower coil 5*b* is energized again, applying a downward force to the intake valve 9. This is to decelerate the intake valve 9 as it moves in the closing direction, thereby lessening shocks imposed when the head of the intake valve 9 is seated on the valve seat 11.

After elapse of the second preset period of time and upon elapse of a third preset time, the lower coil 5*b* is de-energized and the upper coil 5*a* is energized again, so that the magnetic path shown in FIG. 2(*a*) is formed, imposing an upward force on the intake valve 9. The intake valve 9 now closes the intake port, and remains to close the intake port until next opening timing.

The first, second, and third preset times are determined as follows: A table of preset times and engine rotational speeds is stored in advance in the ROM 12*b*, and a preset time corresponding to a certain engine rotational speed is determined from the table based on the rotational speed of the engine 1 detected by the rotation sensor 2.

The opening and closing condition of the valve will be described with reference to FIG. 3.

Figure 3:
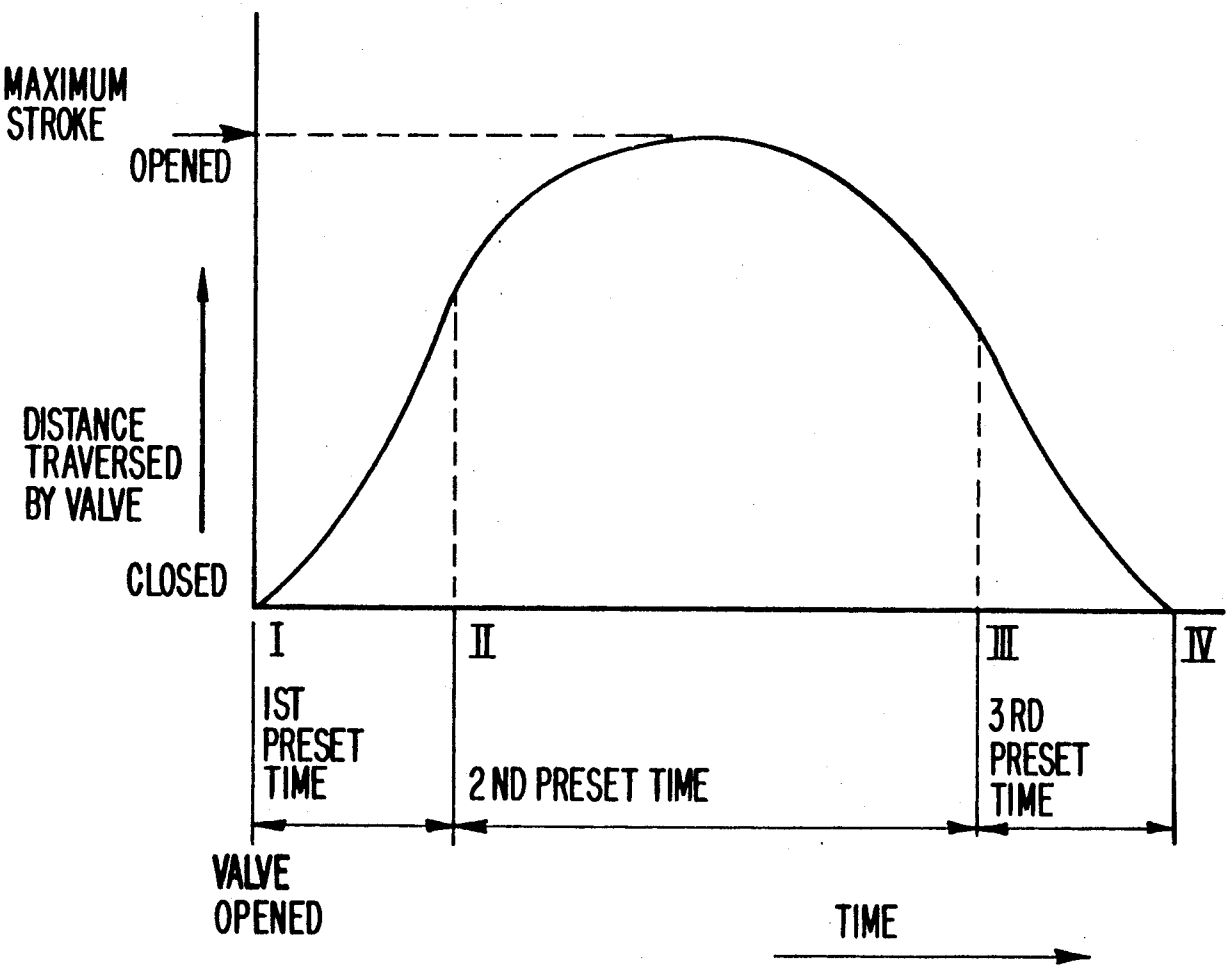
FIG. 3 is a diagram showing the relationship between the distance which the valve moves and time.

FIG. 3 shows a cam profile curve. The horizontal axis of the graph indicates the time from the opening timing of the intake valve 9, and the vertical axis indicates the distance by which the intake valve 9 moves. The curve in FIG. 3 shows the change, over time, in the distance by which the intake valve moves.

At a time I which is the valve opening timing, the upper coil 5*a* is de-energized and the lower coil 5*b* is energized to switch the flow of magnetic lines of force from the condition shown in FIG. 2(*a*) to the condition shown in FIG. 2(*b*). The intake valve 9 is now subjected to an attractive force in the opening direction, and starts moving in the opening direction while being accelerated.

At a time II when the first preset time elapses, energization is switched from the lower coil 5*b* to the upper coil 5*a* to switch the flow of magnetic lines of force from the condition shown in FIG. 2(*b*) to the condition shown in FIG. 2(*c*). An attractive force in the closing direction now acts on the intake valve 9, decelerating the intake valve 9 as it moves in the opening direction. After the intake valve 9 has reached the maximum stroke position, the intake valve 9 reverses its movement for the closing direction.

At a time III when the second preset time elapses, an attractive force in the opening direction is applied again to the intake valve 9, decelerating the intake valve 9 as it moves in the closing direction.

At a time IV when the third preset time elapses, the magnetic lines of force are brought into the condition shown in FIG. 2(*a*). The intake valve 9 remains closed until next opening timing.

When the operation of the engine 1 is finished, the upper and lower coils 5*a*, 5*b* are de-energized, and any electromagnetic forces for holding the intake valve 9 closed are eliminated. Therefore, the intake valve 9 is maintained in the closed position by the spring 8. The holding force of the spring 8 is sufficiently small with respect to the attractive force generated by the lower coil 5*b* to open the intake valve 9.

The ROM 12 may store, in addition to the table of preset times and engine rotational speeds, a map of engine rotational speeds and valve opening timing values. By varying the valve opening timing depending on the engine rotational speed using the map, the engine output and efficiency can be increased in a full range of engine rotational speeds.

Furthermore, an engine cylinder control process for increasing or reducing the number of engine cylinders that are in operation can be carried out by actuating or disabling the intake and exhaust valves associated with the engine cylinders depending on the rotational speed of the engine 1.

While the intake valve has been described above, the actuating system of the present invention is also applicable to the exhaust valve, which is omitted from illustration.

Although a certain preferred embodiment has been shown and described, it should be understood that the pre sent invention should not be limited to the illustrated embodiment but many changes and modifications may be made therein without departing from the scope of the appended claims.

The electromagnetic valve actuating system according to the present invention is useful as a system for actuating intake and exhaust valves of an engine, and suitable for use with an engine which is required to vary the timing to open and close the intake and exhaust valves depending on changes in an operating condition such as the engine rotational speed. Since the amorphous magnetic body on the valve is lightweight, less power is required by the electromagnetic system and the system may therefore be small in size and more efficient to operate.

I claim:

1. An electromagnetic valve actuating system for opening and closing intake and exhaust valves of an engine, comprising:

a movable magnetic pole composed of an amorphous magnetic body wound as multiple layers and mounted for reciprocating movement on a valve;

an upper fixed magnetic pole confronting one end of said movable magnetic pole;

an intermediate fixed magnetic pole (3*b*) coupled to said upper fixed magnetic pole and confronting a side of said movable magnetic pole;

a distal fixed magnetic pole (3*c*) coupled to said intermediate fixed magnetic pole and confronting the other end of said movable magnetic pole;

an upper coil (5*a*) for generating a magnetic flux passing through the upper fixed magnetic pole;

a lower coil (5*b*) for generating a magnetic flux passing through said distal fixed magnetic pole; and energization control means (12) for energizing said upper and lower coils to open and close said valve.

2. An electromagnetic valve actuating system according to claim 1, wherein said valve is made of ceramic.

3. An electromagnetic valve actuating system according to claim 1, wherein said energization control means applies an attractive force acting between said movable magnetic pole and said distal fixed magnetic pole before said valve is seated, thereby lessening shocks produced when the valve is seated.

4. An electromagnetic valve actuating system according to claim 1, wherein the timing established by said energization control means to open and close the valve is variable as the rotation speed of the engine varies.

5. A valve control system in an engine, comprising:

electromagnets having coils;

a valve having a movable magnetic pole composed of an amorphous magnetic body wound in multiple layers on said valve; and control means for controlling movement of said valve by energizing and deenergizing the coils of said electromagnets at timings corresponding to a speed of the engine.

6. A valve control system according to claim 5, further comprising speed detection means for detecting a speed of the engine, and said control means comprising a control unit including an input/output interface connected to said electromagnets and said speed detection means, a storage means for storing a table of the timings corresponding to different speeds of the engine, and a processor calculating the timing based on the speed detected by said detection means.

7. A valve control system according to claim 6, wherein said electromagnets have upper and lower coils, and the valve is moved by alternately energizing the upper and lower coils.

8. A valve control system according to claim 7, wherein said electromagnets comprise upper, intermediate and lower magnetic poles, and wherein said valve is closed by energizing the upper coil and creating a line of magnetic force from the upper magnetic pole through the amorphous magnetic body of said valve to the intermediate magnetic pole and back to the upper magnetic pole, and said valve is opened by deenergizing the upper coil and energizing the lower coil and creating a magnetic line of force from the lower magnetic pole through the amorphous magnetic body of said valve to the intermediate magnetic pole and back to the lower magnetic pole.

9. A method of controlling a valve with an electromagnet in an engine, comprising the steps of (a) providing the valve with an amorphous magnetic body;

(b) detecting the speed of the engine;

(c) reading the speed of the engine into a computer; and (d) energizing and deenergizing the electromagnet at timings corresponding to the speed of the engine, to move the valve by attracting and repelling the amorphous magnetic body, under control of the computer.

10. A method according to claim 9, wherein said energizing and deenergizing of the electromagnets in step (d) is performed at the timings read by the computer from a preset speed/time table based on this speed of the engine.

11. A method according to claim 10, wherein the electromagnets include upper and lower coils and have upper, intermediate and lower magnetic poles, and wherein step (d) further comprises the steps of (d1) holding the valve closed by energizing the upper coil and creating a magnetic line of force from the upper magnetic pole through the amorphous magnetic body to the intermediate magnetic pole and back to the upper magnetic pole, (d2) opening the valve by deenergizing the upper coil and energizing the lower coil and creating a magnetic line of force from the lower magnetic pole through the amorphous magnetic body to the intermediate magnetic pole and back to the lower magnetic pole, (d3) closing the valve by performing step (d1), (d4) decelerating the valve before it is closed by performing step (d2), and (d5) finally closing the valve by performing step (d1).

12. A method according to claim 11, wherein steps (d1) through (d5) are repeated with each full piston stroke of the engine.

* * * * *

UNITED STATES PATENT AND TRADEMARK OFFICE

CERTIFICATE OF CORRECTION

PATENT NO. : 5,070,826

DATED : DECEMBER 10, 1991

INVENTOR(S) : HIDEO KAWAMURA

It is certified that error appears in the above-identified patent and that said Letters Patent is hereby corrected as shown below:

Col. 1, line 19, after "engine.", insert the following paragraph:

--The valves have stems whose ends are pressed by cam surfaces of the camshaft through a link mechanism such as rocker arms or push rods. The intake and exhaust valves are normally closed by springs, and can be opened when their stem ends are pressed by the cam surfaces.--;

line 45, "efficiency when" should be --efficiency only when--.

Col. 4, line 2, "pate 6" should be --plate 6--.

Col. 5, line 67, "pre sent" should be --present--.

Col. 6, line 48, "rotation" should be --rotational--.

Signed and Sealed this

Twentieth Day of April, 1993

*Attest:*

*Attesting Officer*

MICHAEL K. KIRK

*Acting Commissioner of Patents and Trademarks*